US009064498B2

(12) United States Patent
Uhle et al.

(10) Patent No.: US 9,064,498 B2
(45) Date of Patent: Jun. 23, 2015

(54) APPARATUS AND METHOD FOR PROCESSING AN AUDIO SIGNAL FOR SPEECH ENHANCEMENT USING A FEATURE EXTRACTION

(75) Inventors: Christian Uhle, Nuremberg (DE); Oliver Hellmuth, Erlangen (DE); Bernhard Grill, Lauf (DE); Falko Ridderbusch, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 1044 days.

(21) Appl. No.: 13/019,835

(22) Filed: Feb. 2, 2011

(65) Prior Publication Data

US 2011/0191101 A1 Aug. 4, 2011

Related U.S. Application Data

(63) Continuation of application No. PCT/EP2009/005607, filed on Aug. 3, 2009.

(30) Foreign Application Priority Data

Sep. 29, 2008 (EP) ..... 08017124

(51) Int. Cl.
*G10L 19/02* (2013.01)
*G10L 21/0208* (2013.01)
(Continued)

(52) U.S. Cl.
CPC ..... *G10L 21/0208* (2013.01); *G10L 21/0216* (2013.01); *G10L 25/30* (2013.01)

(58) Field of Classification Search
CPC ..... G10L 21/00; G10L 21/02; G10L 21/0208; G10L 21/0232; G10L 21/0364
USPC ..... 704/205, 202, 203, 206, 219
See application file for complete search history.

(56) References Cited

U.S. PATENT DOCUMENTS 5,822,742 A 10/1998 Alkon et al.
5,960,391 A 9/1999 Tateishi et al.
(Continued)

FOREIGN PATENT DOCUMENTS

CN 1210608 3/1999
CN 1836465 9/2006
(Continued)

OTHER PUBLICATIONS

Berouti, M. et al: "Enhancement of speech corrupted by acoustic noise", Proc. of the IEEE Int. Conf. on Acoustics, Speech, and Signal Processing, ICASSP, Apr. 1979, 4 pages.
(Continued)

*Primary Examiner* — Qi Han
(74) *Attorney, Agent, or Firm* — Perkins Coie LLP; Michael A. Glenn

(57) ABSTRACT

An apparatus for processing an audio signal to obtain control information for a speech enhancement filter has a feature extractor for extracting at least one feature per frequency band of a plurality of frequency bands of a short-time spectral representation of a plurality of short-time spectral representations, where the at least one feature represents a spectral shape of the short-time spectral representation in the frequency band. The apparatus additionally has a feature combiner for combining the at least one feature for each frequency band using combination parameters to obtain the control information for the speech enhancement filter for a time portion of the audio signal. The feature combiner can use a neural network regression method, which is based on combination parameters determined in a training phase for the neural network.

14 Claims, 9 Drawing Sheets

(51) Int. Cl.
*G10L 21/0216* (2013.01)
*G10L 25/30* (2013.01)

(56) References Cited

U.S. PATENT DOCUMENTS

| | | | | |
|---|---|---|---|---|
| 6,226,605 | B1 | 5/2001 | Nejime et al. | |
| 6,324,502 | B1 | 11/2001 | Handel et al. | |
| 6,408,273 | B1 | 6/2002 | Quagliaro et al. | |
| 6,820,053 | B1 | 11/2004 | Ruwisch | |
| 7,171,246 | B2 | 1/2007 | Mattila et al. | |
| 7,580,536 | B2 | 8/2009 | Carlile et al. | |
| 8,521,530 | B1 * | 8/2013 | Every et al. | 704/251 |
| 2003/0014248 | A1 | 1/2003 | Vetter | |
| 2005/0114128 | A1 * | 5/2005 | Hetherington et al. | 704/233 |
| 2008/0140396 | A1 | 6/2008 | Grosse-Schulte et al. | |
| 2008/0167866 | A1 | 7/2008 | Hetherington et al. | |
| 2010/0179808 | A1 * | 7/2010 | Brown | 704/225 |

FOREIGN PATENT DOCUMENTS

| | | | |
|---|---|---|---|
| CN | 101178898 | | 5/2008 |
| EP | 0981816 | | 3/2000 |
| EP | 1091349 | A | 4/2001 |
| EP | 1791113 | | 5/2007 |
| JP | 3247011 | | 1/2002 |
| JP | 2003131686 | | 5/2003 |
| JP | 2004341339 | | 12/2004 |
| KR | 1019980700787 | | 3/1998 |
| WO | WO-9617488 | | 6/1996 |

OTHER PUBLICATIONS

Boll, S.: "Suppression of acoustic noise in speech using spectral subtraction", IEEE Trans. on Acoustics, Speech, and Signal Processing, vol. 27, No. 2, pp. 113-120, Apr. 1979.
Cohen, I.: "Noise estimation by minima controlled recursive averaging for robust speech enhancement", IEEE Signal Proc. Letters, vol. 9, No. 1, pp. 12-15, Jan. 2002.
Doblinger, G.: "Computationally Efficient Speech Enhancement by Spectral Minima Tracking in Subbands", Proc. of Eurospeech, Madrid, Spain, Sep. 1995, 4 pages.
Frazier, R. et al: "Enhancement of speech by adaptive filtering", Proc. of the IEEE Int. Conf. on Acoustics, Speech, and Signal Processing, ICASSP, Philadelphia, USA, Apr. 1976, pp. 251-253.
Hermansky, H. et al: "RASTA Processing of Speech", IEEE Trans. on Speech and Audio Processing, vol. 2, No. 4, pp. 578-589, Oct. 1994.
Hermansky, H.: "Perceptual Linear Predictive Analysis for Speech", J. Ac. Soc. Am., vol. 87, No. 4, pp. 1738-1752, 1990.
Hirsch, H. et al: "Noise estimation techniques for robust speech recognition", Proc. of the IEEE Int. Conf. on Acoustics, Speech, and Signal Processing, ICASSP, Detroit, USA, May 1995, pp. 153-156.
Jensen, J. et al: "Speech enhancement using a constrained iterative sinusoidal model", IEEE Trans. on Speech and Audio Processing, vol. 9. No. 7, pp. 731-740, Oct. 2001.
Kamath, S. et al: "A multi-band spectral subtraction method for enhancing speech corrupted by colored noise", Proc. of the IEEE Int. Conf. Acoust. Speech Signal Processing, May 2002, 4 pages.
Kleinschmidt, M. et al: "Sub-band SNR estimation using auditory feature processing", Speech Communication: Special Issue on Speech Processing for Hearing Aids, vol. 39, pp. 47-64, 2003.
Lim, J. et al: "Enhancement and bandwidth compression of noisy speech", Proc. of the IEEE, vol. 67, No. 12, pp. 1586-1604, Dec. 1979.
Lin, L. et al: "Adaptive noise estimation algorithm for speech enhancement", Electronic Letters, vol. 39, No. 9, pp. 754-755, May 2003.
Loizou, P.: "Speech Enhancement: Theory and Practice"; 2007; CRC Press, pp. 110-111 and pp. 400-419.
Martin, R.: "Spectral subtraction based on minimum statistics", Proc. of EUSIPCO, Edinburgh, UK, Sep. 1994, pp. 1182-1185.
Mesgarani, N. et al: "Speech enhancement based on filtering the spectro-temporal modulations", Proc. of the IEEE Int. Conf. on Acoustics, Speech, and Signal Processing, ICASSP, Philadelphia, USA, Mar. 2005, pp. I-1105-I-1108.
Openshaw, J.P. et al: "A comparison of composite features under degraded speech in speaker recognition", Plenary, Special, Audio, Underwater Acoustics, VLSI, Neural Networks. Minneapolis, Apr. 27-30, 1993; [Proceedings of the International Conference on Acoustics, Speech, and Signal Processing (ICASSP)], New York, IEEE, US, vol. 2, Apr. 27, 1993, pp. 371-374.
Tchorz, J. et al: "SNR Estimation based on amplitude modulation analysis with applications to noise suppression"; May 2003; IEEE Trans. on Speech and Audio Processing, vol. 11, No. 3, pp. 184-192.
Uhle, C. et al: "A Supervised Learning Approach to Ambience Extraction From Mono Recordings for Blind Upmixing", Proc. of the 11$^{th}$ Conf. on Digital Audio Effects (DAFX-08), Sep. 1, 2008-Sep. 4, 2008, pp. 1-8.
Virag, N.: "Single channel speech enhancement based on masking properties of the human auditory system", IEEE Trans. Speech and Audio Proc., vol. 7, No. 2, pp. 126-137, Mar. 1999.
International Search Report and Written Opinion mailed Dec. 17, 2009 in related PCT patent application No. PCT/EP2009/005607, 14 pages.

* cited by examiner $$Y(\omega) = G(\omega)X(\omega)$$

$$G(\omega) = \sqrt{1 - \frac{|\hat{B}(\omega)|^2}{|X(\omega)|^2}}$$

$$G(\omega) = \sqrt{\frac{\hat{R}(\omega)}{\hat{R}(\omega) + 1}}$$

control information can be:
- SNR ($\hat{R}(\omega)$) per band
- speech energy $\hat{S}(\omega)$ per band
- background "noise" energy $\hat{B}(\omega)$ per band
- filter parameters for controllable filter to obtain desired filtering $$G(\omega) = \begin{cases} \dfrac{\hat{R}(\omega)^{\alpha}}{\hat{R}(\omega)^{\alpha} + 1} & \Big| \ \hat{R}(\omega) \leq 1 \\ \dfrac{\hat{R}(\omega)^{\beta}}{\hat{R}(\omega)^{\beta} + 1} & \Big| \ \hat{R}(\omega) > 1 \end{cases}$$

e.g. $\alpha = 3{,}5$
$\beta = 1$
limit at -18dB

- features per frequency band (weighting band e.g. Bark band)

- spectral energy in band
  - spectral shape in band
    (distribution of energy within the band)

- spectral flatness measure $\left(\frac{\text{geometric mean}}{\text{arithmetic mean}}\right)$
    - spectral shewness

- spectral flux between successive frames
  - delta or delta-delta features

- features for the full bandwidth

- LPC coefficients and/or LPC error signal
  - Mel-frequency cepstral coefficients
  - relative spectra perceptual linear prediction coefficients (RAST A-PLP)
  - delta or delta-delta features

FIGURE 6

APPARATUS AND METHOD FOR PROCESSING AN AUDIO SIGNAL FOR SPEECH ENHANCEMENT USING A FEATURE EXTRACTION

CROSS-REFERENCE TO RELATED APPLICATIONS

This application is a continuation of copending International Application No. PCT/EP2009/005607, filed Aug. 3, 2009, which is incorporated herein by reference in its entirety, and additionally claims priority from U.S. Application No. 61/086,361, filed Aug. 5, 2008, U.S. 61/100,826, filed Sep. 29, 2008 and European Patent Application No. 08017124.2, filed Sep. 29, 2008, which are all incorporated herein by reference in their entirety.

BACKGROUND OF THE INVENTION

The present invention is in the field of audio signal processing and, particularly, in the field of speech enhancement of audio signals, so that a processed signal has speech content, which has an improved objective or subjective speech intelligibility.

Speech enhancement is applied in different applications. A prominent application is the use of digital signal processing in hearing aids. Digital signal processing in hearing aids offers new, effective means for the rehabilitation of hearing impairment. Apart from higher acoustic signal quality, digital hearing-aids allow for the implementation of specific speech processing strategies. For many of these strategies, an estimate of the speech-to-noise ratio (SNR) of the acoustical environment is desirable. Specifically, applications are considered in which complex algorithms for speech processing are optimized for specific acoustic environments, but such algorithms might fail in situations that do not meet the specific assumptions. This holds true especially for noise reduction schemes that might introduce processing artifacts in quiet environments or in situations where the SNR is below a certain threshold. An optimum choice for parameters of compression algorithms and amplification might depend on the speech-to-noise ratio, so that an adaption of the parameter set depending on SNR estimates help in proving the benefit. Furthermore, SNR estimates could directly be used as control parameters for noise reduction schemes, such as Wiener filtering or spectral subtraction.

Other applications are in the field of speech enhancement of a movie sound. It has been found that many people have problems understanding the speech content of a movie, e.g., due to hearing impairments. In order to follow the plot of a movie, it is important to understand the relevant speech of the audio track, e.g. monologues, dialogues, announcements and narrations. People who are hard of hearing often experience that background sounds, e.g. environmental noise and music are presented at a too high level with respect to the speech. In this case, it is desired to increase the level of the speech signals and to attenuate the background sounds or, generally, to increase the level of the speech signal with respect to the total level.

A prominent approach to speech enhancement is spectral weighting, also referred to as short-term spectral attenuation, as illustrated in FIG. 3. The output signal y[k] is computed by attenuating the sub-band signals X(ω) of the input signals x[k] depending on the noise energy within the sub-band signals.

In the following the input signal x[k] is assumed to be an additive mixture of the desired speech signal s[k] and background noise b[k].

$$x[k]=s[k]+b[k]. \tag{1}$$

Speech enhancement is the improvement in the objective intelligibility and/or subjective quality of speech.

A frequency domain representation of the input signal is computed by means of a Short-term Fourier Transform (STFT), other time-frequency transforms or a filter bank as indicated at 30. The input signal is then filtered in the frequency domain according to Equation 2, whereas the frequency response G(ω) of the filter is computed such that the noise energy is reduced. The output signal is computed by means of the inverse processing of the time-frequency transforms or filter bank, respectively.

$$Y(\omega)=G(\omega)X(\omega) \tag{2}$$

Appropriate spectral weights G(ω) are computed at 31 for each spectral value using the input signal spectrum X(ω) and an estimate of the noise spectrum $\hat{B}(\omega)$ or, equivalently, using an estimate of the linear sub-band SNR $\hat{R}(\omega)=\hat{S}(\omega)/\hat{B}(\omega)$. The weighted spectral value are transformed back to the time domain in 32. Prominent examples of noise suppression rules are spectral subtraction [S. Boll, "Suppression of acoustic noise in speech using spectral subtraction", *IEEE Trans. on Acoustics, Speech, and Signal Processing*, vol. 27, no. 2, pp. 113-120, 1979] and Wiener filtering. Assuming that the input signal is an additive mixture of the speech and the noise signals and that speech and noise are uncorrelated, the gain values for the spectral subtraction method are given in Equation 3.

$$G(\omega)=\sqrt{1-\frac{|\hat{B}(\omega)|^2}{|X(\omega)|^2}} \tag{3}$$

Similar weights are derived from estimates of the linear sub-band SNR R(ω) according to Equation 4.

Channel $$G(\omega)=\sqrt{\frac{\hat{R}(\omega)}{\hat{R}(\omega)+1}} \tag{4}$$

Various extensions to spectral subtraction have been proposed in the past, namely the use of an oversubtraction factor and spectral floor parameter [M. Berouti, R. Schwartz, J. Makhoul, "Enhancement of speech corrupted by acoustic noise", *Proc. of the IEEE Int. Conf. on Acoustics, Speech, and Signal Processing, ICASSP,* 1979], generalized forms [J. Lim, A. Oppenheim, "Enhancement and bandwidth compression of noisy speech", *Proc. of the IEEE*, vol 67, no. 12, pp. 1586-1604, 1979], the use of perceptual criteria (e.g. N. Virag, "Single channel speech enhancement based on masking properties of the human auditory system", *IEEE Trans. Speech and Audio Proc.*, vol. 7, no. 2, pp. 126-137, 1999) and multi-band spectral subtraction (e.g. S. Kamath, P. Loizou, "A multi-band spectral subtraction method for enhancing speech corrupted by colored noise", *Proc. of the IEEE Int. Conf. Acoust. Speech Signal Processing,* 2002). However, the crucial part of a spectral weighting method is the estimation of the instantaneous noise spectrum or of the sub-band SNR, which is prone to errors especially if the noise is non-stationary. Errors of the noise estimation lead to residual noise, distortions of the speech components or musical noise (an artefact which has been described as "warbling with tonal quality" [P. Loizou, *Speech Enhancement: Theory and Practice*, CRC Press, 2007]).

A simple approach to noise estimation is to measure and averaging the noise spectrum during speech pauses. This approach does not yield satisfying results if the noise spectrum varies over time during speech activity and if the detection of the speech pauses fails. Methods for estimating the noise spectrum even during speech activity have been proposed in the past and can be classified according to P. Loizou, *Speech Enhancement: Theory and Practice, CRC Press,* 2007 as Minimum tracking algorithms Time-recursive averaging algorithms Histogram based algorithms The estimation of the noise spectrum using minimum statistics has been proposed in R. Martin, "Spectral subtraction based on minimum statistics", *Proc. of EUSIPCO, Edingburgh, UK,* 1994. The method is based on the tracking of local minima of the signal energy in each sub-band. A non-linear update rule for the noise estimate and faster updating has been proposed in G. Doblinger, "Computationally Efficient Speech Enhancement By Spectral Minima Tracking In Subbands", *Proc. of Eurospeech, Madrid, Spain,* 1995.

Time-recursive averaging algorithms estimate and update the noise spectrum whenever the estimated SNR at a particular frequency band is very low. This is done by computing recursively the weighted average of the past noise estimate and the present spectrum. The weights are determined as a function of the probability that speech is present or as a function of the estimated SNR in the particular frequency band, e.g. in I. Cohen, "Noise estimation by minima controlled recursive averaging for robust speech enhancement", *IEEE Signal Proc. Letters*, vol. 9, no. 1, pp. 12-15, 2002, and in L. Lin, W. Holmes, E. Ambikairajah, "Adaptive noise estimation algorithm for speech enhancement", *Electronic Letters*, vol. 39, no. 9, pp. 754-755, 2003.

Histogram-based methods rely on the assumption that the histogram of the sub-band energy is often bimodal. A large low-energy mode accumulates energy values of segments without speech or with low-energy segments of speech. The high-energy mode accumulates energy values of segments with voiced speech and noise. The noise energy in a particular sub-band is determined from the low-energy mode [H. Hirsch, C. Ehrlicher, "Noise estimation techniques for robust speech recognition", *Proc. of the IEEE Int. Conf on Acoustics, Speech, and Signal Processing, ICASSP, Detroit*, USA, 1995]. For a comprehensive recent review it is referred to P. Loizou, *Speech Enhancement: Theory and Practice*, CRC Press, 2007.

Methods for the estimation of the sub-band SNR based on supervised learning using amplitude modulation features are reported in J. Tchorz, B. Kollmeier, "SNR Estimation based on amplitude modulation analysis with applications to noise suppression", *IEEE Trans. On Speech and Audio Processing*, vol. 11, no. 3, pp. 184-192, 2003, and in M. Kleinschmidt, V. Hohmann, "Sub-band SNR estimation using auditory feature processing", *Speech Communication: Special Issue on Speech Processing for Hearing Aids*, vol. 39, pp. 47-64, 2003.

Other approaches to speech enhancement are pitch-synchronous filtering (e.g. in R. Frazier, S. Samsam, L. Braida, A. Oppenheim, "Enhancement of speech by adaptive filtering", *Proc. of the IEEE Int. Conf. on Acoustics, Speech, and Signal Processing*, ICASSP, Philadelphia, USA, 1976), filtering of Spectro Temporal Modulation (STM) (e.g. in N. Mesgarani, S. Shamma, "Speech enhancement based on filtering the spectro-temporal modulations", *Proc. of the IEEE Int. Conf. on Acoustics, Speech, and Signal Processing*, ICASSP, Philadelphia, USA, 2005), and filtering based on a sinusoidal model representation of the input signal (e.g. J. Jensen, J. Hansen, "Speech enhancement using a constrained iterative sinusoidal model", *IEEE Trans. on Speech and Audio Processing*, vol. 9, no. 7, pp. 731-740, 2001).

The methods for the estimation of the sub-band SNR based on supervised learning using amplitude modulation features as reported in J. Tchorz, B. Kollmeier, "SNR Estimation based on amplitude modulation analysis with applications to noise suppression", *IEEE Trans. On Speech and Audio Processing*, vol. 11, no. 3, pp. 184-192, 2003, and in M. Kleinschmidt, V. Hohmann, "Sub-band SNR estimation using auditory feature processing", *Speech Communication: Special Issue on Speech Processing for Hearing Aids*, vol. 39, pp. 47-64, 200312, 13 are disadvantageous in that two spectrogram processing steps are needed. The first spectrogram processing step is to generate a time/frequency spectrogram of the time-domain audio signal. Then, in order to generate the modulation spectrogram, another "time/frequency" transform is needed, which transforms the spectral information from the spectral domain into the modulation domain. Due to the inherent systematic delay and the time/frequency resolution issue inherent to any transform algorithm, this additional transform operation incurs problems.

An additional consequence of this procedure is that noise estimates are quite non-accurate in conditions where the noise is non-stationary and where various noise signals may occur.

SUMMARY

According to an embodiment, an apparatus for processing an audio signal to obtain control information for a speech enhancement filter, may have a feature extractor for obtaining a time sequence of short-time spectral representations of the audio signal and for extracting at least one feature in each frequency band of a plurality of frequency bands for a plurality of short-time spectral representations, the at least one feature representing a spectral shape of a short-time spectral representation in a frequency band of the plurality of frequency bands; and a feature combiner for combining the at least one feature for each frequency band using combination parameters to obtain the control information for the speech enhancement filter for a time portion of the audio signal.

According to another embodiment, a method of processing an audio signal to obtain control information for a speech enhancement filter may have the steps of obtaining a time sequence of short-time spectral representations of the audio signal; extracting at least one feature in each frequency band of a plurality of frequency bands for a plurality of short-time spectral representations, the at least one feature representing a spectral shape of a short-time spectral representation in a frequency band of the plurality of frequency bands; and combining the at least one feature for each frequency band using combination parameters to obtain the control information for the speech enhancement filter for a time portion of the audio signal.

According to another embodiment, an apparatus for speech enhancing in an audio signal may have an apparatus for processing the audio signal for obtaining filter control information for a plurality of bands representing a time portion of the audio signal; and a controllable filter, the filter being controllable so that a band of the audio signal is variably attenuated with respect to a different band based on the control information.

According to another embodiment, a method of speech enhancing in an audio signal may have a method of processing the audio signal for obtaining filter control information for a plurality of bands representing a time portion of the audio signal; and controlling a filter so that a band of the audio signal is variably attenuated with respect to a different band based on the control information.

According to another embodiment, an apparatus for training a feature combiner for determining combination parameters of the feature combiner may have a feature extractor for obtaining a time sequence of short-time spectral representations of a training audio signal, for which a control information for a speech enhancement filter per frequency band is known, and for extracting at least one feature in each frequency band of the plurality of frequency bands for a plurality of short-time spectral representations, the at least one feature representing a spectral shape of a short-time spectral representation in a frequency band of the plurality of frequency bands; and an optimization controller for feeding the feature combiner with the at least one feature for each frequency band, for calculating the control information using intermediate combination parameters, for varying the intermediate combination parameters, for comparing the varied control information to the known control information, and for updating the intermediate combination parameters, when the varied intermediate combination parameters result in control information better matching with the known control information.

According to another embodiment, a method of training a feature combiner for determining combination parameters of the feature combiner may have the steps of obtaining a time sequence of short-time spectral representations of a training audio signal, for which a control information for a speech enhancement filter per frequency band is known; extracting at least one feature in each frequency band of the plurality of frequency bands for a plurality of short-time spectral representations, the at least one feature representing a spectral shape of a short-time spectral representation in a frequency band of the plurality of frequency bands; feeding the feature combiner with the at least one feature for each frequency band; calculating the control information using intermediate combination parameters; varying the intermediate combination parameters; comparing the varied control information to the known control information; updating the intermediate combination parameters, when the varied intermediate combination parameters result in control information better matching with the known control information.

According to another embodiment, a computer program may perform, when running on a computer, any one of the inventive methods.

The present invention is based on the finding that a band-wise information on the spectral shape of the audio signal within the specific band is a very useful parameter for determining control information for a speech enhancement filter. Specifically, a band-wise-determined spectral shape information feature for a plurality of bands and for a plurality of subsequent short-time spectral representations provides a useful feature description of an audio signal for speech enhancement processing of the audio signal. Specifically, a set of spectral shape features, where each spectral shape feature is associated with a band of a plurality of spectral bands, such as Bark bands or, generally, bands having a variable bandwidth over the frequency range already provides a useful feature set for determining signal/noise ratios for each band. To this end, the spectral shape features for a plurality of bands are processed via a feature combiner for combining these features using combination parameters to obtain the control information for the speech enhancement filter for a time portion of the audio signal for each band. Advantageously, the feature combiner includes a neural network, which is controlled by many combination parameters, where these combination parameters are determined in a training phase, which is performed before actually performing the speech enhancement filtering. Specifically, the neural network performs a neural network regression method. A specific advantage is that the combination parameters can be determined within a training phase using audio material, which can be different from the actual speech-enhanced audio material, so that the training phase has to be performed only a single time and, after this training phase, the combination parameters are fixedly set and can be applied to each unknown audio signal having a speech, which is comparable to a speech characteristic of the training signals. Such a speech characteristic can, for example, be a language or a group of languages, such as European languages versus Asian languages, etc.

Advantageously, the inventive concept estimates the noise by learning the characteristics of the speech using feature extraction and neural networks, where the inventively extracted features are straight-forward low-level spectral features, which can be extracted in an efficient and easy way, and, importantly, which can be extracted without a large system-inherent delay, so that the inventive concept is specifically useful for providing an accurate noise or SNR estimate, even in a situation where the noise is non-stationary and where various noise signals occur.

BRIEF DESCRIPTION OF THE DRAWINGS

Embodiments of the present invention are subsequently discussed in more detail by referring to the attached drawings in which:

FIG. 6 is an overview over the features per frequency band and additional features for the full bandwidth;

DETAILED DESCRIPTION OF THE INVENTION

Figure 1:
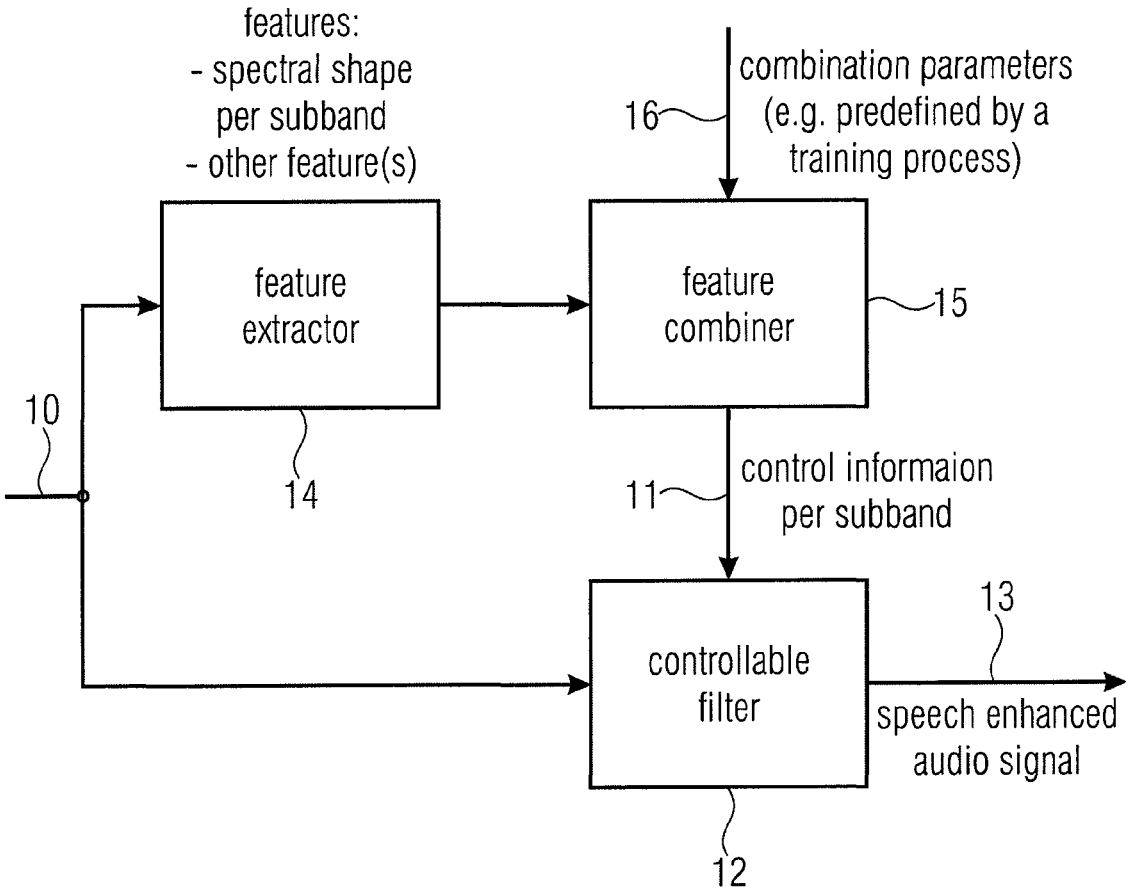
FIG. 1 is a block diagram of an apparatus or method for processing an audio signal.

FIG. 1 illustrates an apparatus for processing an audio signal 10 to obtain control information 11 for a speech enhancement filter 12. The speech enhancement filter can be implemented in many ways, such as a controllable filter for filtering the audio signal 10 using the control information per frequency band for each of the plurality of frequency bands to obtain a speech enhanced audio output signal 13. As illustrated later, the controllable filter can also be implemented as a time/frequency conversion, where individually calculated gain factors are applied to the spectral values or spectral bands followed by a subsequently performed frequency/time conversion.

The apparatus of FIG. 1 comprises a feature extractor 14 for obtaining a time sequence of short-time spectral representations of the audio signal and for extracting at least one feature in each frequency band of a plurality of frequency bands for a plurality of short-time spectral representations where the at least one feature represents a spectral shape of a short-time spectral representation in a frequency band of the plurality of frequency bands. Additionally, the feature extractor 14 may be implemented to extract other features apart from spectral-shape features. At the output of the feature extractor 14 several features per audio short-time spectrum exist where these several features at least include a spectral shape feature for each frequency band of a plurality of at least 10 or more, such as 20 to 30 frequency bands. These features can be used as they are, or can be processed using an average processing or any other processing, such as the geometric average or arithmetic average or median processing or other statistical moments processing (such as variance, skewness, . . . ) in order to obtain, for each band, a raw feature or an averaged feature, so that all these raw and/or averaged features are input into a feature combiner 15. The feature combiner 15 combines the plurality of spectral shape features and additional features using combination parameters, which can be provided via a combination parameter input 16, or which are hard-wired or hard-programmed within the feature combiner 15 so that the combination parameter input 16 is not required. At the output of the feature combiner, the control information for the speech enhancement filter for each frequency band or "sub-band" of the plurality of frequency bands or the plurality of sub-bands is obtained for a time portion of the audio signal.

Figure 2:
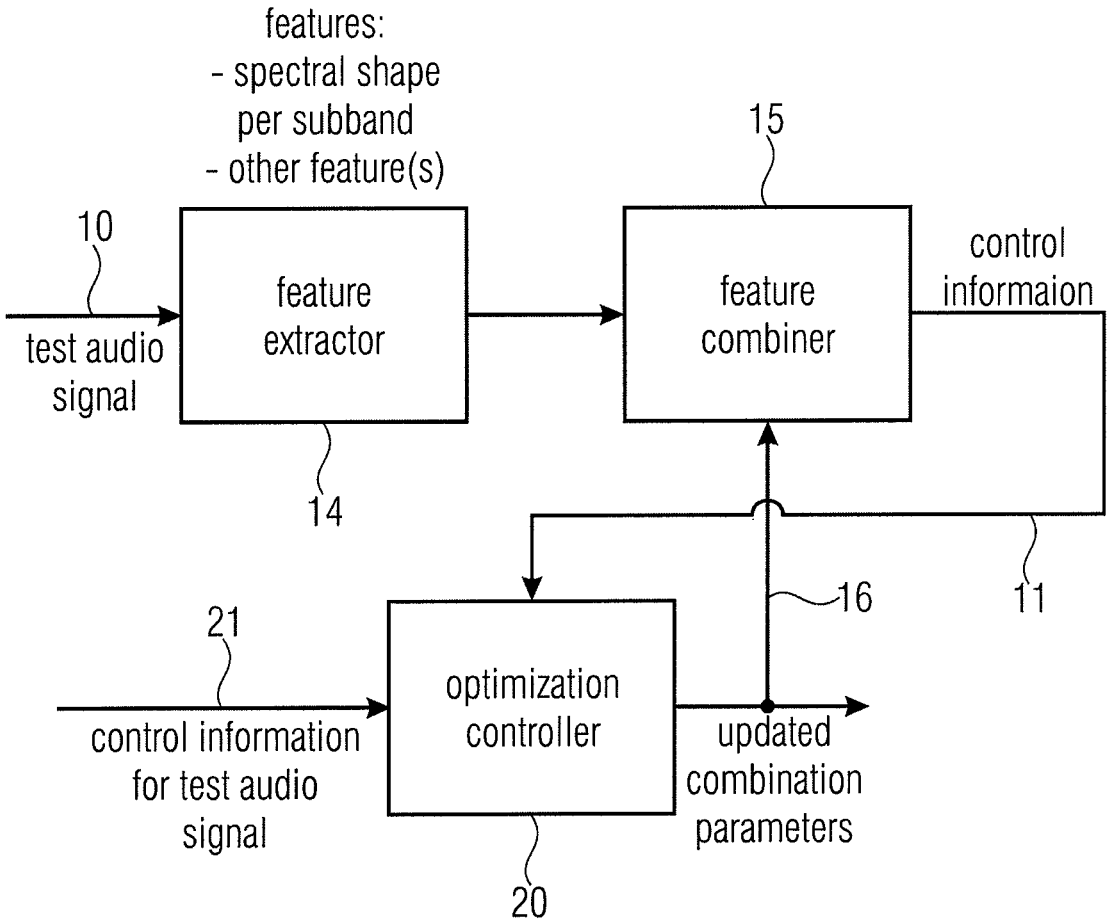
FIG. 2 is a block diagram of an apparatus or method for training a feature combiner in accordance with an embodiment of the present invention.

Advantageously, the feature combiner 15 is implemented as a neural network regression circuit, but the feature combiner can also be implemented as any other numerically or statistically controlled feature combiner, which applies any combination operation to the features output by the feature extractor 14, so that, in the end, the necessitated control information, such as a band-wise SNR value or a band-wise gain factor results. In the embodiment of a neural network application, a training phase ("training phase" means a phase in which learning from examples is performed) is needed. In this training phase, an apparatus for training a feature combiner 15 as indicated in FIG. 2 is used. Specifically, FIG. 2 illustrates this apparatus for training a feature combiner 15 for determining combination parameters of the feature combiner. To this end, the apparatus in FIG. 2 comprises the feature extractor 14, which is implemented in the same way as the feature extractor 14 of FIG. 1. Furthermore, the feature combiner 15 is also implemented in the same way as the feature combiner 15 of FIG. 1.

In addition to FIG. 1, the apparatus in FIG. 2 comprises an optimization controller 20, which receives, as an input, control information for a training audio signal as indicated at 21. The training phase is performed based on known training audio signals, which have a known speech/noise ratio in each band. The speech portion and the noise portion are—for example—provided separately from each other and the actual SNR per band is measured on the fly, i.e. during the learning operation. Specifically, the optimization controller 20 is operative for controlling the feature combiner, so that the feature combiner is fed with the features from the feature extractor 14. Based on these features and intermediate combination parameters coming from a preceding iteration run, the feature combiner 15 then calculates control information 11. This control information 11 is forwarded to the optimization controller and is, in the optimization controller 20 compared to the control information 21 for the training audio signal. The intermediate combination parameters are varied in response to an instruction from the optimization controller 20 and, using this varied combination parameters, a further set of control information is calculated by the feature combiner 15. When the further control information better matches the control information for the training audio signal 21, the optimization controller 20 updates the combination parameters and sends these updated combination parameters 16 to the feature combiner to be used in the next run as intermediate combination parameters. Alternatively, or additionally, the updated combination parameters can be stored in a memory for further use.

Figure 4:
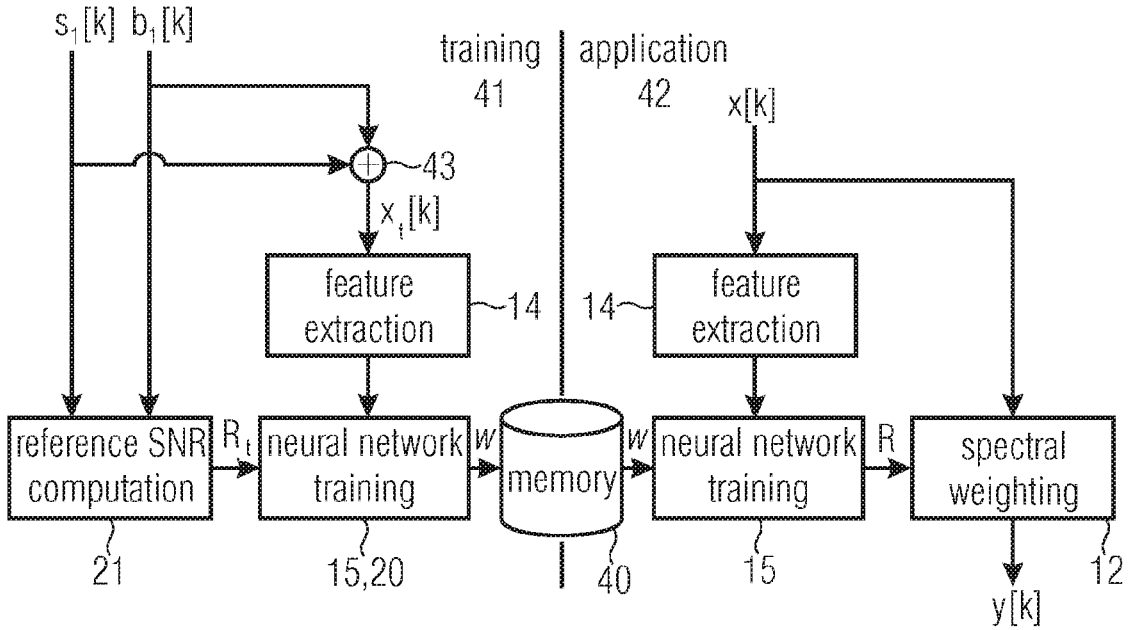
FIG. 4 illustrates an overview over the procedure for training a feature combiner and for applying a neural network regression using the optimized combination parameters.

FIG. 4 illustrates an overview of a spectral weighting processing using feature extraction in the neural network regression method. The parameters w of the neural network are computed using the reference sub-band SNR values $R_t$ and features from the training items $x_t[k]$ during the training phase, which is indicated on the left-hand side of FIG. 4. The noise estimation and speech enhancement filtering is shown on the right-hand side of FIG. 4.

The proposed concept follows the approach of spectral weighting and uses a novel method for the computation of the spectral weights. The noise estimation is based on a supervised learning method and uses an inventive feature set. The features aim at the discrimination of tonal versus noisy signal components. Additionally, the proposed features take the evolution of signal properties on a larger time scale into account.

The noise estimation method presented here is able to deal with a variety of non-stationary background sounds. A robust SNR estimation in non-stationary background noise is obtained by means of feature extraction and a neural network regression method as illustrated in FIG. 4. The real-valued weights are computed from estimates of the SNR in frequency bands whose spacing approximates the Bark scale. The spectral resolution of the SNR estimation is rather coarse to enable the measurement of a spectral shape in a band.

The left-hand side of FIG. 4 corresponds to a training phase which, basically, has to be performed only once. The procedure at the left-hand side of FIG. 4 indicated as training 41 includes a reference SNR computation block 21, which generates the control information 21 for a training audio signal input into the optimization controller 20 of FIG. 2. The feature extraction device 14 in FIG. 4 on the training side corresponds to the feature extractor 14 of FIG. 2. In particular, FIG. 2 has been illustrated to receive a training audio signal, which consists of a speech portion and a background portion. In order to be able to perform a useful reference, the background portion $b_t$ and the speech portion $s_t$ are separately available from each other and are added via an adder 43 before being input into the feature extraction device 14. Thus, the output of the adder 43 corresponds to the training audio signal input into the feature extractor 14 in FIG. 2.

The neural network training device indicated at 15, 20 corresponds to blocks 15 and 20 and the corresponding connection as indicated in FIG. 2 or as implemented via other similar connections results in a set of combination parameters w, which can be stored in the memory 40. These combination parameters are then used in the neural network regression device 15 corresponding to the feature combiner 15 of FIG. 1 when the inventive concept is applied as indicated via application 42 in FIG. 4. The spectral weighting device in FIG. 4 corresponds to the controllable filter 12 of FIG. 1 and the feature extractor 14 in FIG. 4, right-hand side corresponds to the feature extractor 14 in FIG. 1.

In the following, a brief realization of the proposed concept will be discussed in detail. The feature extraction device 14 in FIG. 4 operates as follows.

A set of 21 different features has been investigated in order to identify the best feature set for the estimation of the sub-band SNR. These features were combined in various configurations and were evaluated by means of objective measurements and informal listening. The feature selection process results in a feature set comprising the spectral energy, the spectral flux, the spectral flatness, the spectral skewness, the LPC and the RASTA-PLP coefficients. The spectral energy, flux, flatness and skewness features are computed from the spectral coefficient corresponding to the critical band scale.

The features are detailed with respect to FIG. 6. Additional features are the delta feature of the spectral energy and the delta-delta feature of the low-pass filtered spectral energy and of the spectral flux.

Figure 10:
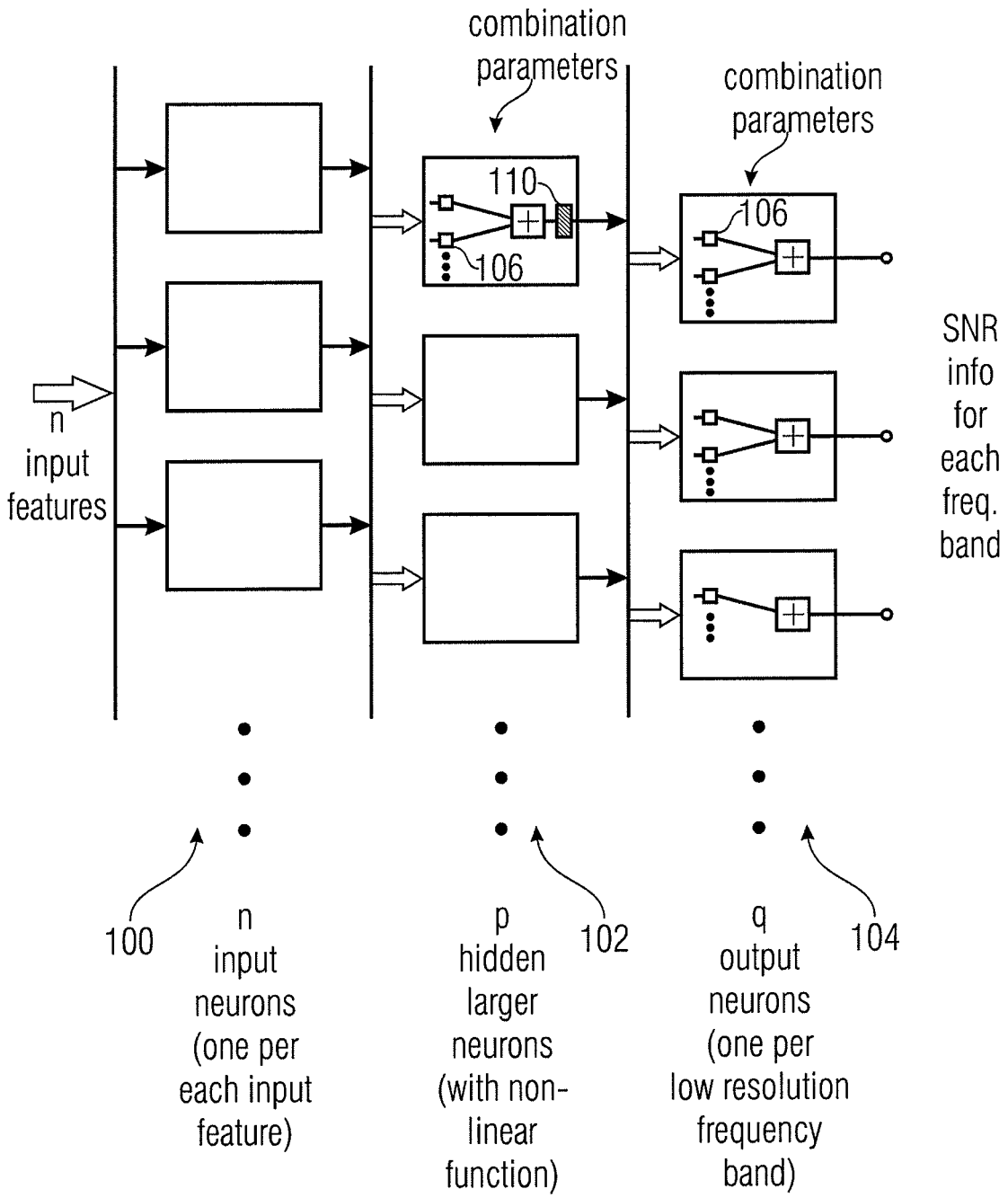
FIG. 10 is a schematic block diagram of an implementation of the feature combiner using a multi-layer neural network.

The structure of the neural network used in blocks 15, 20 or 15 in FIG. 4 or used in the feature combiner 15 in FIG. 1 or FIG. 2 is discussed in connection with FIG. 10. In particular, the neural network includes a layer of input neurons 100. Generally, n input neurons can be used, i.e. one neuron per each input feature. Advantageously, the neuron network has 220 input neurons corresponding to the number of features. The neural network furthermore comprises a hidden layer 102 with p hidden layer neurons. Generally, p is smaller than n and in the embodiment, the hidden layer has 50 neurons. On the output side, the neural network includes an output layer 104 with q output neurons. In particular, the number of output neurons is equal to the number of frequency bands so that each output neuron provides a control information for each frequency band such as an SNR (Speech-to-Noise Ratio) information for each frequency band. If, for example, 25 different frequency bands exist advantageously having a bandwidth, which increases from low to high frequencies, then the output neurons' number q will be equal to 25. Thus, the neural network is applied for the estimation of the sub-band SNR from the computed low-level features. The neural network has, as stated above, 220 input neurons and one hidden layer 102 with 50 neurons. The number of output neurons equals the number of frequency bands. Advantageously, the hidden neurons include an activation function, which is the hyperbolic tangent and the activation function of the output neurons is the identity.

Generally, each neuron from layer 102 or 104 receives all corresponding inputs, which are, with respect to layer 102, the outputs of all input neurons. Then, each neuron of layer 102 or 104 performs a weighted addition where the weighting parameters correspond to the combination parameters. The hidden layer can comprise bias values in addition to the parameters. Then, the bias values also belong to the combination parameters. In particular, each input is weighted by its corresponding combination parameter and the output of the weighting operation, which is indicated by an exemplary box 106 in FIG. 10 is input into an adder 108 within each neuron. The output of the adder or an input into a neuron may comprise a non-linear function 110, which can be placed at the output and/or input of a neuron e.g. in the hidden layer as the case may be.

The weights of the neural network are trained on mixtures of clean speech signals and background noises whose reference SNR are computed using the separated signals. The training process is illustrated on the left hand side of FIG. 4. Speech and noise are mixed with an SNR of 3 dB per item and fed into the feature extraction. This SNR is constant over time and a broadband SNR value. The data set comprises 2304 combinations of 48 speech signals and 48 noise signals of 2.5 seconds length each. The speech signals originated of different speakers with 7 languages. The noise signals are recordings of traffic noise, crowd noise, and various natural atmospheres.

For a given spectral weighting rule, two definitions of the output of the neural network are appropriate: The neural network can be trained using the reference values for the time-varying sub-band SNR $R(\omega)$ or with the spectral weights $G(\omega)$ (derived from the SNR values). Simulations with sub-band SNR as reference values yielded better objective results and better ratings in informal listening compared to nets which were trained with spectral weights. The neural network is trained using 100 iteration cycles. A training algorithm is used in this work, which is based on scaled conjugate gradients.

Embodiments of the spectral weighting operation 12 will subsequently be discussed.

The estimated sub-band SNR estimates are linearly interpolated to the frequency resolution of the input spectra and transformed to linear ratios $\hat{R}$. The linear sub-band SNR are smoothed along time and along frequency using IIR low-pass filtering to reduce artifacts, which may result from estimation errors. The low-pass filtering along frequency is further needed to reduce the effect of circular convolution, which occurs if the impulse response of the spectral weighting exceeds the length of the DFT frames. It is performed twice, whereas the second filtering is done in reversed order (starting with the last sample) such that the resulting filter has zero phases.

Figure 5:
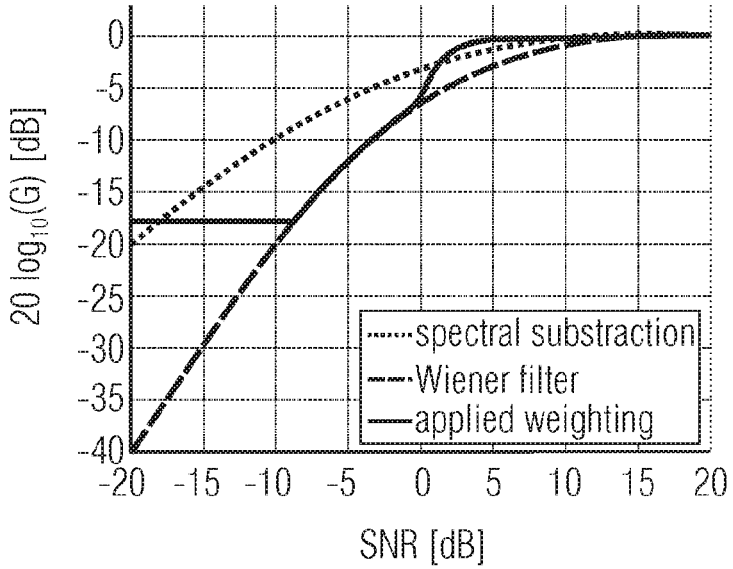
FIG. 5 is a plot illustrating the gain factor as a function of the SNR, where the applied gains (solid line) are compared to the spectral subtraction gains (dotted line) and the Wiener filter (dashed line)

FIG. 5 illustrates the gain factor as a function of the SNR. The applied gain (solid line) are compared to the spectral subjection gains (dotted line) and the Wiener filter (dashed line).

The spectral weights are computed according to the modified spectral subtraction rule in Equation 5 and limited to −18 dB.

$$G(\omega) = \begin{cases} \dfrac{\hat{R}(\omega)^{\alpha}}{\hat{R}(\omega)^{\alpha}+1} & \hat{R}(\omega) \le 1 \\ \dfrac{\hat{R}(\omega)^{\beta}}{\hat{R}(\omega)^{\beta}+1} & \hat{R}(\omega) > 1 \end{cases} \tag{5}$$

The parameters $\alpha=3.5$ and $\beta=1$ are determined experimentally. This particular attenuation above 0 dB SNR is chosen in order to avoid distortions of the speech signal at the expense of residual noise. The attenuation curve as a function of the SNR is illustrated in FIG. 5.

Figure 9:
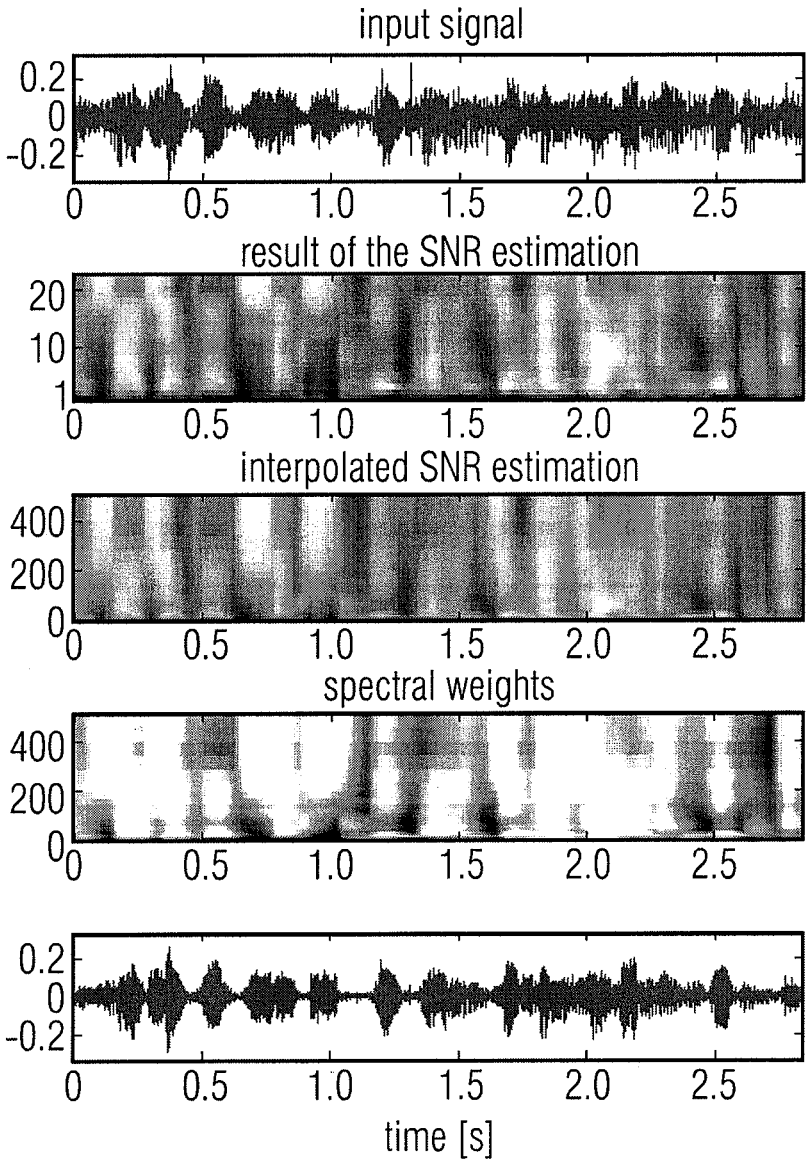
FIG. 9 illustrates an example of the spectral weighting, where the input time signal, the estimated sub-band SNR, the estimated SNR in frequency bins after interpolation, the spectral weights and the processed time signal are illustrated.

FIG. 9 shows an example for the input and output signals, the estimated sub-band SNR and the spectral weights.

Specifically, FIG. 9 has an example of the spectral weighting: Input time signal, estimated sub-band SNR, estimated SNR in frequency bins after interpolation, spectral weights and processed time signal.

FIG. 6 illustrates an overview over the features to be extracted by the feature extractor 14. The feature extractor prefers, for each low resolution, a frequency band, i.e. for each of the frequency bands for which an SNR or gain value is needed, a feature representing the spectral shape of the short time spectral representation in the frequency band. The spectral shape in the band represents the distribution of energy within the band and can be implemented via several different calculation rules.

An advantageous spectral shape feature is the spectral flatness measure (SFM), which is the geometric mean of the spectral values divided by the arithmetic mean of the spectral values. In the geometric mean/arithmetic mean definition, a power can be applied to each spectral value in the band before performing the n-th root operation or the averaging operation.

Generally, a spectral flatness measure can also be calculated when the power for processing each spectral value in the calculation formula for the SFM in the denominator is higher than the power used for the nominator. Then, both, the denominator and the nominator may include an arithmetic value calculation formula. Exemplarily, the power in the nominator is 2 and the power in the denominator is 1. Generally, the power used in the nominator only has to be larger than the power used in the denominator to obtain a generalized spectral flatness measure.

Other spectral shape features include the spectral skewness, which measures the asymmetry of the distribution around its centroid. There exist other features which are related to the spectral shape of a short time frequency representation within a certain frequency band.

While the spectral shape is calculated for a frequency band, other features exist, which are calculated for a frequency band as well as indicated in FIG. 6 and as discussed in detail below. And, additional features also exist, which do not necessarily have to be calculated for a frequency band, but which are calculated for the full bandwidth.

Spectral Energy

The spectral energy is computed for each time frame and frequency band and normalized by the total energy of the frame. Additionally, the spectral energy is low-pass filtered over time using a second-order IIR filter.

Spectral Flux

The spectral flux SF is defined as the dissimilarity between spectra of successive frames 20 and is frequently implemented by means of a distance function. In this work, the spectral flux is computed using the Euclidian distance according to Equation 6, with spectral coefficients X(m,k), time frame index m, sub-band index r, lower and upper boundary of the frequency band $l_r$ and $u_r$, respectively.

$$SF(m, r) = \sqrt{\sum_{q=l_r}^{u_r} (|X(m, q)| - |X(m-1, q)|)^2} \tag{6}$$

Spectral Flatness Measure

Various definitions for the computation of the flatness of a vector or the tonality of a spectrum (which is inversely related to the flatness of a spectrum) exist. The spectral flatness measure SFM used here is computed as the ratio of the geometric mean and the arithmetic mean of the L spectral coefficients of the sub-band signal as shown in Equation 7.

$$SFM(m, r) = \frac{e^{\left(\sum_{q=l_r}^{u_r} \log(|X(m,q)|)\right)/L}}{\frac{1}{L}\sum_{q=l_r}^{u_r} |X(m, q)|} \tag{7}$$

Spectral Skewness

The skewness of a distribution measures its asymmetry around its centroid and is defined as the third central moment of a random variable divided by the cube of its standard deviation.

Linear Prediction Coefficients

The LPC are the coefficients of an all-pole filter, which predicts the actual value x(k) of a time series from the preceding values such that the squared error $E=\Sigma_k(\hat{x}_k-x_k)^2$ is minimized.

$$\hat{x}(k) = -\sum_{j=1}^{p} a_j x_{k-j} \tag{8}$$

The LPC are computed by means of the autocorrelation method.

Mel-Frequency Cepstral Coefficients

The power spectra are warped according to the mel-scale using triangular weighting functions with unit weight for each frequency band. The MFCC are computed by taking the logarithm and computing the Discrete Cosine Transform.

Relative Spectra Perceptual Linear Prediction Coefficients

The RASTA-PLP coefficients [H. Hermansky, N. Morgan, "RASTA Processing of Speech", IEEE Trans. On Speech and Audio Processing, vol. 2, no. 4, pp. 578-589, 1994] are computed from the power spectra in the following steps:

1. Magnitude compression of the spectral coefficients
2. Band-pass filtering of the sub-band energy over time
3. Magnitude expansion which relates to the inverse processing of step 2
4. Multiplication with weights that correspond to an equal loudness curve
5. Simulation of loudness sensation by raising the coefficients to the power of 0.33
6. Computation of an all-pole model of resulting spectrum by means of the autocorrelation method Perceptual Linear Prediction (PLP) Coefficients The PLP values are computed similar to the RASTA-PLP but without applying steps 1-3 [H. Hermansky, "Perceptual Linear Predictive Analysis for Speech", J. Ac. Soc. Am., vol. 87, no. 4, pp. 1738-1752, 1990].

Delta Features

Delta features have been successfully applied in automatic speech recognition and audio content classification in the past. Various ways for their computation exist. Here, they are computed by means of convolving the time sequence of a feature with a linear slope with a length of 9 samples (the sampling rate of the feature time series equals the frame rate of the STFT). Delta-delta features are obtained by applying the delta operation to the delta features.

As indicated above, it is advantageous to have a band separation of the low-resolution frequency band, which is similar to the perceptual situation of the human hearing system. Therefore, a logarithmic band separation or a Bark-like band separation is advantageous. This means that the bands having a low center frequency are narrower than the bands having a high center frequency. In the calculation of the spectral flatness measure, for example, the summing operation extends from a value q, which is normally the lowest frequency value in a band and extends to the count value $u_r$, which is the highest spectral value within a predefined band. In order to have a better spectral flatness measure, it is advantageous to use, in the lower bands, at least some or all spectral values from the lower and/or the upper adjacent frequency band. This means that, for example, the spectral flatness measure for the second band is calculated using the spectral values of the second band and, additionally, using the spectral values of the first band and/or the third band. In the embodiment, not only the spectral values of either the first or the second bands are used, but also the spectral values of the first band and the third band are used. This means that when calculating the SFM for the second band, q in the Equation (7) extends from $l_r$ equal to the first (lowest) spectral value of the first band and $u_r$ is equal to the highest spectral value in the third band. Thus, a spectral shape feature, which is based on a higher number of spectral values, can be calculated until a certain bandwidth at which the number of spectral values within the band itself is sufficient so that $l_r$ and $u_r$ indicate spectral values from the same low-resolution frequency band.

Regarding the linear prediction coefficients, which are extracted by the feature extractor, it is advantageous to either use the LPC $a_j$ of Equation (8) or the residual/error values remaining after the optimization or any combination of the coefficients and the error values such as a multiplication or an addition with a normalization factor so that the coefficients as well as the squared error values influence the LPC feature extracted by the feature extractor.

An advantage of the spectral shape feature is that it is a low-dimensional feature. When, for example, the frequency bandwidth having 10 complex or real spectral values is considered, the usage of all these 10 complex or real spectral values would not be useful and would be a waste of computational resources. Therefore, the spectral shape feature is extracted, which has a dimension, which is lower than the dimension of the raw data. When, for example, the energy is considered, then the raw data has a dimension of 10, since 10 squared spectral values exist. In order to extract the spectral-shape feature, which can be efficiently used, a spectral-shape feature is extracted, which has a dimension smaller than the dimension of the raw data and which is at 1 or 2. A similar dimension-reduction with respect to the raw data can be obtained when, for example, a low-level polynomial fit to a spectral envelope of a frequency band is done. When, for example, only two or three parameters are fitted, then the spectral-shape feature includes these two or three parameters of a polynomial or any other parameterization system. Generally, all parameters, which indicate the distribution of energy within a frequency band and which have a low dimension of less than 5% or at least less than 50% or only less than 30% of the dimension of raw data are useful.

It has been found out that the usage of the spectral shape feature alone already results in an advantageous behavior of the apparatus for processing an audio signal, but it is advantageous to use at least an additional band-wise feature. It has also been shown that the additional band-wise feature useful in providing improved results is the spectral energy per band, which is computed for each time frame and frequency band and normalized by the total energy of the frame. This feature can be low-passed filtered or not. Additionally, it has been found out that the addition of the spectral flux feature advantageously enhances the performance of the inventive apparatus so that an efficient procedure resulting in a good performance is obtained when the spectral shape feature per band is used in addition to the spectral energy feature per band and the spectral flux feature per band. In addition to the additional features, this again enhances the performance of the inventive apparatus.

As discussed with respect to the spectral energy feature, a low-pass filtering of this feature over time or applying a moving average normalization over time can be applied, but does not have to necessarily be applied. In the former case, an average of, for example, the five preceding spectral shape features for the corresponding band are calculated and the result of this calculation is used as the spectral shape feature for the current band in the current frame. This averaging, however, can also be applied bi-directionally, so that for the averaging operation, not only features from the past, but also features from the "future" are used to calculate the current feature.

Figure 7:
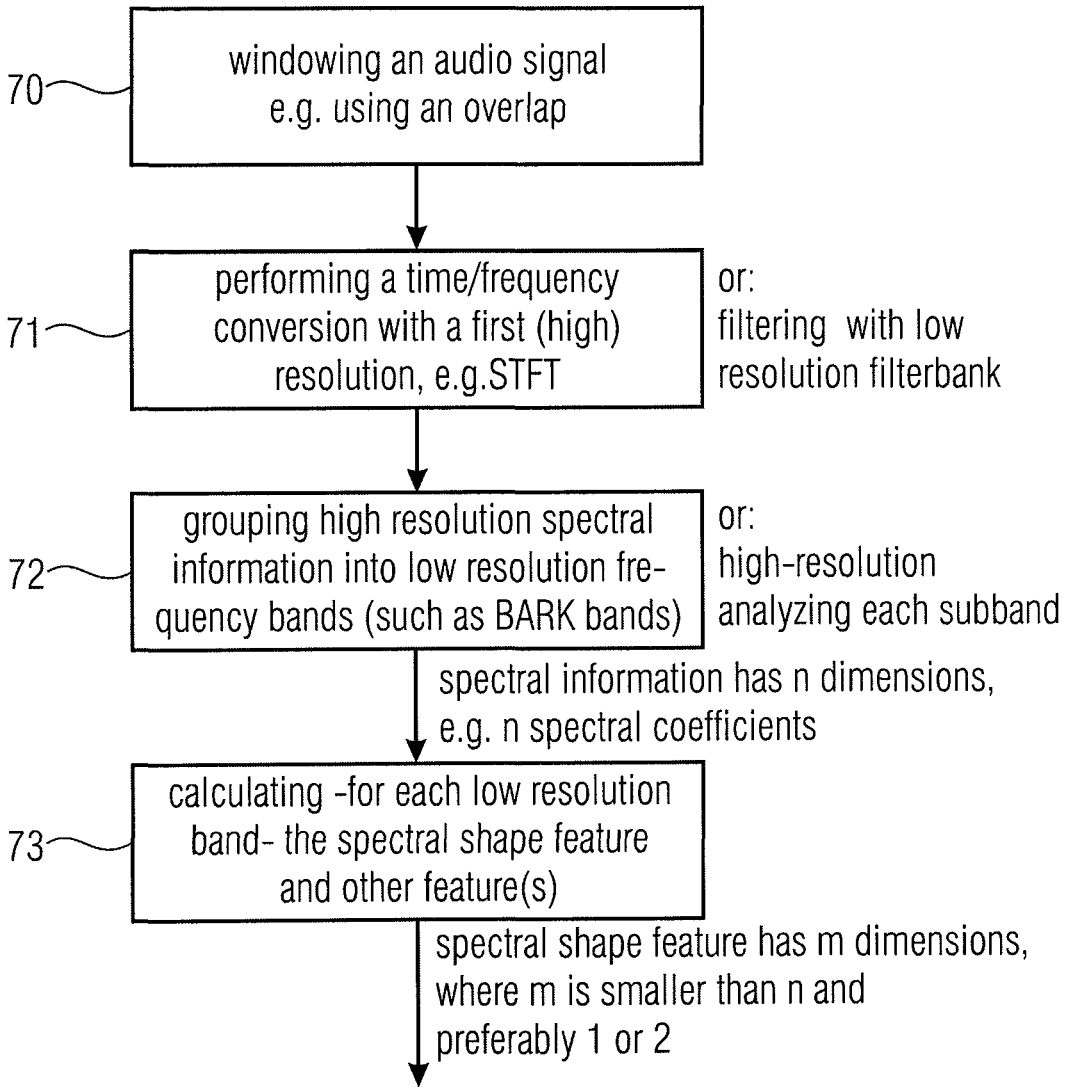
FIG. 7 is a flow chart for illustrating an implementation of the feature extractor.
Figure 8:
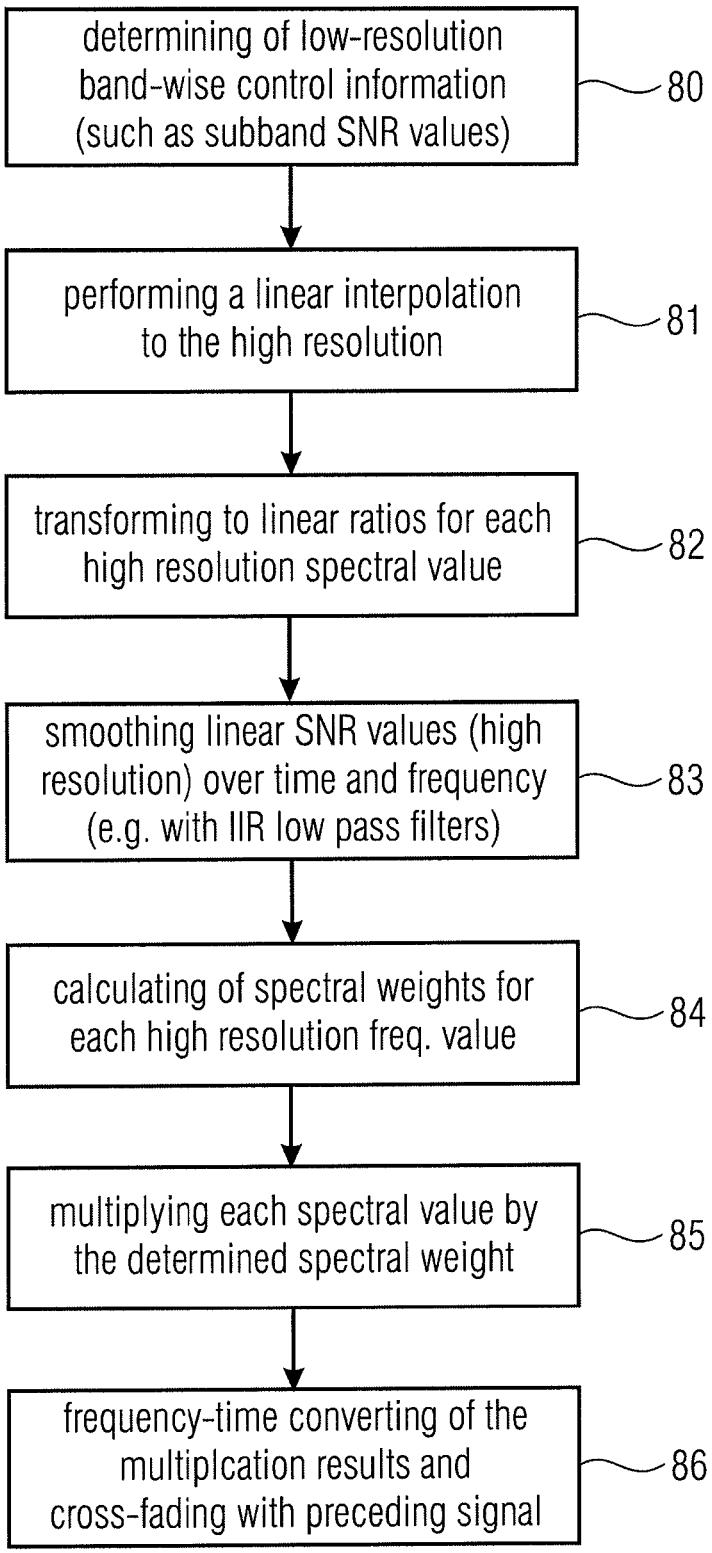
FIG. 8 illustrates a flow chart for illustrating an implementation of the calculation of the gain factors per frequency value and the subsequent calculation of the speech-enhanced audio signal portion.

FIGS. 7 and 8 will subsequently be discussed in order to provide the implementation of the feature extractor 14 as illustrated in FIG. 1, FIG. 2 or FIG. 4. In a first step, an audio signal is windowed in order to provide a block of audio sampling values as indicated in step 70. Advantageously, an overlap is applied. This means that one and the same audio sample occurs in two successive frames due to the overlap range, where an overlap of 50% with respect to the audio sampling values is advantageous. In step 71, a time/frequency conversion of a block of windowed audio sampling values is performed in order to obtain a frequency representation with a first resolution, which is a high resolution. To this end, a short-time Fourier transform (STFT) implemented with an efficient FFT is obtained. When step 71 is applied several times with temporally succeeding blocks of audio sampling values, a spectrogram is obtained as known in the art. In step 72, the high-resolution spectral information, i.e. the high-resolution spectral values are grouped into low-resolution frequency bands. When, for example, an FFT with 1024 or 2048 input values is applied, 1024 or 2048 spectral values exist, but such a high resolution is neither required nor intended. Instead, the grouping step 72 results in a division of the high resolution spectrum into a small number of bands, such as bands having a varying bandwidth as, for example, known from Bark bands or from a logarithmic band division. Then, subsequent to the step of grouping 72, a calculation 73 of the spectral shape feature and other features is performed for each of the low-resolution bands. Although not indicated in FIG. 7, additional features relating to the whole frequency band can be calculated using the data obtained at step 70, since for these full-band width features, any spectral separations obtained by step 71 or step 72 are not required.

Step 73 results in spectral shape features, which have m dimensions, where m is smaller than n and is 1 or 2 per frequency band. This means that the information for a frequency band present after step 72 is compressed into a low dimension information present after step 73 by the feature extractor operation.

As indicated in FIG. 7 near step 71 and step 72, the step of time/frequency conversion and grouping can be replaced for different operations. The output of step 70 can be filtered with a low-resolution filter bank which, for example, is implemented so that at the output, sub-band signals are obtained. The high-resolution analysis of each sub-band can then be performed to obtain the raw data for the spectral shape feature calculation. This can be done, for example, by an FFT analysis of a sub-band signal or by any other analysis of a sub-band signal, such as by further cascaded filter banks.

Figure 3:
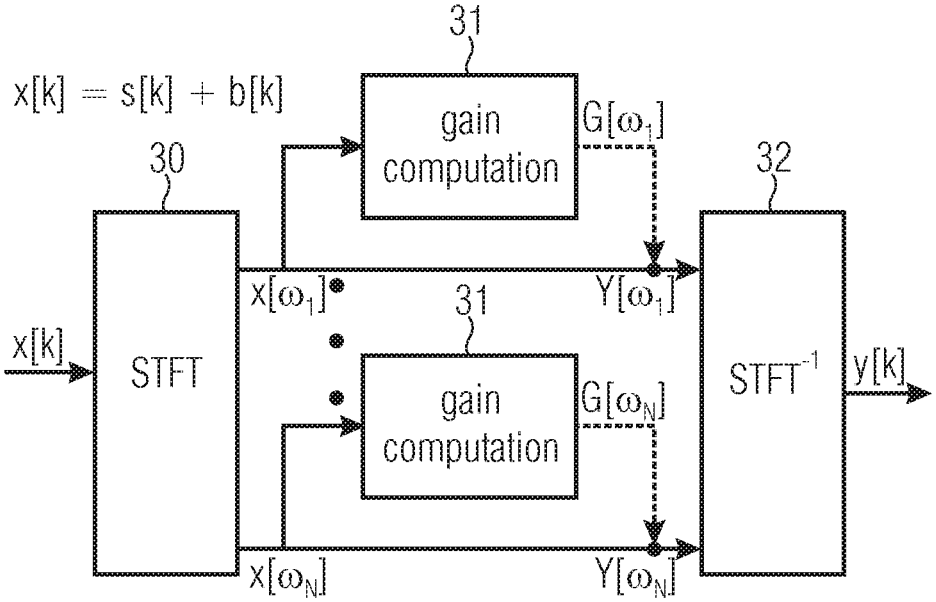
FIGURE 3 (PRIOR ART)
FIG. 3 is a block diagram for illustrating a speech enhancement apparatus and method in accordance with an embodiment of the present invention.

FIG. 8 illustrates the procedure for implementing the controllable filter 12 of FIG. 1 or the spectral weighting feature illustrated in FIG. 3 or indicated at 12 in FIG. 4. Subsequent to the step of determining the low resolution band-wise control information, such as the sub-band SNR values, which are output by the neural network regression block 15 of FIG. 4, as indicated at step 80, a linear interpolation to the high resolution in step 81 is performed.

It is the purpose to finally obtain a weighting factor for each spectral value obtained by the short-time Fourier transform performed in step 30 of FIG. 3 or performed in step 71 or the alternative procedure indicated to the right of steps 71 and 72. Subsequent to step 81, an SNR value for each spectral value is obtained. However, this SNR value is still in the logarithmic domain and step 82 provides a transformation of the logarithmic domain into a linear domain for each high-resolution spectral value.

In step 83, the linear SNR values for each spectral value, i.e. at the high resolution are smoothed over time and frequency, such as using IIR low-pass filters or, alternatively, FIR low-pass filters, e.g. any moving average operations can be applied. In step 84, the spectral weights for each high-resolution frequency values are calculated based on the smoothed linear SNR values. This calculation relies on the function indicated in FIG. 5, although the function indicated in this Fig. is given in logarithmic terms, while the spectral weights for each high-resolution frequency value in step 84 are calculated in the linear domain.

In step 85, each spectral value is then multiplied by the determined spectral weight to obtain a set of high-resolution spectral values, which have been multiplied by the set of spectral weights. This processed spectrum is frequency-time converted in step 86. Depending on the application scenario and depending on the overlap used in step 80, a cross-fading operation can be performed between two blocks of time domain audio sampling values obtained by two subsequent frequency-time converting steps to address blocking artifacts.

Additional windowing can be applied to reduce circular convolution artifacts.

The result of step 86 is a block of audio sampling values, which has an improved speech performance, i.e. the speech can be perceived better than compared to the corresponding audio input signal where the speech enhancement has not been performed.

Depending on certain implementation requirements of the inventive methods, the inventive methods can be implemented in hardware or in software. The implementation can be performed using a digital storage medium, in particular, a disc, a DVD or a CD having electronically-readable control signals stored thereon, which co-operate with programmable computer systems such that the inventive methods are performed. Generally, the present invention is therefore a computer program product with a program code stored on a machine-readable carrier, the program code being operated for performing the inventive methods when the computer program product runs on a computer. In other words, the inventive methods are, therefore, a computer program having a program code for performing at least one of the inventive methods when the computer program runs on a computer.

The described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. Apparatus for processing an audio signal to acquire control information for a speech enhancement filter, comprising:

a feature extractor configured for acquiring a time sequence of short-time spectral representations of the audio signal from a sequence of time portions of the audio signal, the sequence of time portions comprising a current time portion and another time portion configured for extracting, for each frequency band of a plurality of frequency bands and for each time portion in the sequence of time portions, a raw feature for the time portion of the audio signal from a short-time spectral representation corresponding to the time portion of the audio signal to obtain a first sequence of raw features for each frequency band for the current time portion and a second sequence of raw features for each frequency band for the another time portion, the another time portion being a past time portion or a future time portion with respect to the current time portion, and configured for combining, for each frequency band of the plurality of frequency bands, a raw feature in the first sequence of raw features in a frequency band for the current time portion and a raw feature in the second sequence of raw features in the same frequency band for the another time portion to acquire at least one feature in each frequency band of a plurality of frequency bands for a plurality of short-time spectral representations for the current time portion and the another time portion, the features for each frequency band of the plurality of frequency bands representing a spectral shape of the plurality of short-time spectral representations; and a feature combiner for combining the at least one feature for each frequency band for the plurality of short-time spectral representations and a raw feature extracted from only the short-time spectral representation corresponding to the current time portion of the audio signal using combination parameters predetermined by a training process to acquire the control information for the speech enhancement filter for the current time portion of the audio signal, wherein at least one of the feature extractor and the feature combiner comprises a hardware implementation.

2. Apparatus in accordance with claim 1, in which the feature extractor is operative to extract at least one additional feature representing a characteristic of a short-time spectral representation different from the spectral shape, and in which the feature combiner is operative to combine the at least one additional feature and the at least one feature for each frequency band using the combination parameters.

3. Apparatus in accordance with claim 1, in which the feature extractor is operative to apply a frequency conversion operation, in which, for a sequence of time instants, a sequence of spectral representations is acquired, the spectral representations comprising frequency bands with non-uniform bandwidths, a bandwidth becoming larger with an increasing center frequency of a frequency band.

4. Apparatus in accordance with claim 1, in which the feature extractor is operative to calculate, as the first feature, a spectral flatness measure per band representing a distribution of energy within the band, or as a second feature, a measure of a normalized energy per band, the normalization being based on the total energy of a signal frame, from which the spectral representation is derived, and wherein the feature combiner is operative to use the spectral flatness measure for a band or the normalized energy per band.

5. Apparatus in accordance with claim 1, in which the feature extractor is operative to additionally extract, for each band, a spectral flux measure representing a similarity or a dissimilarity between time-successive spectral representations or a spectral skewness measure, the spectral skewness measure representing an asymmetry around a centroid.

6. Apparatus in accordance with claim 1, in which the feature extractor is operative to additionally extract LPC features, the LPC features including an LPC error signal, linear prediction coefficients until a predefined order or a combination of the LPC error signals and linear prediction coefficients, or in which the feature extractor is operative to additionally extract PLP coefficients or RASTA-PLP coefficients or mel-frequency cepstral coefficients or delta features.

7. Apparatus in accordance with claim 6, in which the feature extractor is operative to calculate the linear prediction coefficient features for a block of time-domain audio samples, the block including audio samples used for extracting the at least one feature representing the spectral shape for each frequency band.

8. Apparatus in accordance with claim 1, in which the feature extractor is operative to calculate the shape of the spectrum in a frequency band using spectral information of one or two immediately adjacent frequency bands and the spectral information of the frequency band only.

9. Apparatus in accordance with claim 1, in which the feature extractor is operative to calculate, for each frequency band, a number of spectral values and to combine the number of spectral values to acquire the at least one feature representing the spectral shape so that the at least one feature comprises a dimension, which is smaller than the number of spectral values in the frequency band.

10. Method of processing an audio signal to acquire control information for a speech enhancement filter, comprising:

acquiring a time sequence of short-time spectral representations of the audio signal from a sequence of time portions of the audio signal, the sequence of time portions comprising a current time portion and another time portion;

extracting, by a feature extractor, for each frequency band of a plurality of frequency bands and for each time portion in the sequence of time portions, a raw feature for the time portion of the audio signal from a short-time spectral representation corresponding to the time portion of the audio signal to obtain a first sequence of raw features for each frequency band for the current time portion and a second sequence of raw features for each frequency band for the another time portion, the another time portion being a past time portion or a future time portion with respect to the current time portion, and combining, by the feature extractor, for each frequency band of the plurality of frequency bands, a raw feature in the first sequence of raw features in a frequency band for the current time portion and a raw feature in the second sequence of raw features in the same frequency band for the another time portion to acquire at least one feature in each frequency band of a plurality of frequency bands for a plurality of short-time spectral representations for the current time portion and the another time portion, the features for each frequency band of the plurality of frequency bands representing a spectral shape of the plurality of short-time spectral representations; and combining, by a feature combiner, the at least one feature for each frequency band for the plurality of short-time spectral representations and a raw feature extracted from only the short-time spectral representation corresponding to the current time portion of the audio signal using combination parameters predetermined by a training process to acquire the control information for the speech enhancement filter for a time portion of the audio signal, wherein at least one of the feature extractor and the feature combiner comprises a hardware implementation.

11. Apparatus for speech enhancing in an audio signal, comprising:

an apparatus for processing the audio signal in accordance with claim 1 for acquiring filter control information for a speech enhancement filter and for a plurality of bands representing a time portion of the audio signal; and the speech enhancement filter, the speech enhancement filter being controllable so that a band of the audio signal is variably attenuated with respect to a different band based on the control information.

12. Apparatus in accordance with claim 11, in which the apparatus for processing the audio signal further comprises a time frequency converter providing spectral information comprising a first spectral resolution, the first spectral resolution being higher than a second spectral resolution, for which the control information is provided; and in which the apparatus for processing the audio signal additionally comprises a control information post-processor configured for interpolating the control information to the first resolution and configured for smoothing the interpolated control information to acquire a post-processed control information based on which controllable filter parameters of the speech enhancement filter are set.

13. Method of speech enhancing an audio signal, comprising:

a method of processing the audio signal to acquire control information for a speech enhancement filter of claim 10 controlling the speech enhancement filter so that a band of the audio signal is variably attenuated with respect to a different band based on the filter control information.

14. Non-transitory storage medium having stored thereon a computer program for performing, when running on a computer, a method of processing an audio signal to acquire control information for a speech enhancement filter, comprising:

acquiring a time sequence of short-time spectral representations of the audio signal from a sequence of time portions of the audio signal, the sequence of time portions comprising a current time portion and another time portion;

extracting, for each frequency band of a plurality of frequency bands and for each time portion in the sequence of time portions, a raw feature for the time portion of the audio signal from a short-time spectral representation corresponding to the time portion of the audio signal to obtain a first sequence of raw features for each frequency band for the current time portion and a second sequence of raw features for each frequency band for the another time portion, the another time portion being a past time portion or a future time portion with respect to the current time portion, and combining, for each frequency band of the plurality of frequency bands, a raw feature in the first sequence of raw features in a frequency band for the current time portion and a raw feature in the second sequence of raw features in the same frequency band for the another time portion to acquire at least one feature in each frequency band of a plurality of frequency bands for a plurality of short-time spectral representations for the current time portion and the another time portion, the features for each frequency band of the plurality of frequency bands representing a spectral shape of the plurality of short-time spectral representations; and combining the at least one feature for each frequency band for the plurality of short-time spectral representations and a raw feature extracted from only the short-time spectral representation corresponding to the current time portion of the audio signal using combination parameters predetermined by a training process to acquire the control information for the speech enhancement filter for the current time portion of the audio signal.

* * * * *